United States Patent [19]

Gillispie et al.

[11] Patent Number: 4,645,099

[45] Date of Patent: Feb. 24, 1987

[54] SAFETY CONTAINER FOR FLAMMABLE LIQUIDS

[75] Inventors: John G. Gillispie; Donald J. Mitchell, both of Wellsburg, W. Va.

[73] Assignee: Eagle Manufacturing Company, Wellsburg, W. Va.

[21] Appl. No.: 788,006

[22] Filed: Oct. 16, 1985

[51] Int. Cl.[4] ..... B65D 47/08

[52] U.S. Cl. ..... 222/472; 222/475; 222/487

[58] Field of Search ..... 222/469–475, 222/487

[56] References Cited

U.S. PATENT DOCUMENTS

| | | | |
|---|---|---|---|
| 1,745,456 | 2/1930 | Shuler | 222/487 |
| 2,275,318 | 3/1942 | Rasmssen | 222/487 |
| 2,335,195 | 11/1943 | Packer . | |
| 2,490,194 | 12/1949 | Barclay | 222/470 |
| 2,547,847 | 4/1951 | Barclay | 222/487 |
| 2,764,318 | 9/1956 | Lisciani | 222/487 |
| 3,727,807 | 4/1973 | Flider . | |
| 3,729,122 | 4/1973 | Flider . | |
| 3,794,235 | 2/1974 | Flider | 222/471 |
| 4,063,667 | 12/1977 | Flider . | |
| 4,491,251 | 1/1985 | Flider . | |

*Primary Examiner*—George E. Lowrance

*Attorney, Agent, or Firm*—Parmelee, Miller, Welsh & Kratz

[57] ABSTRACT

A safety container having two openings, one having a pouring spout attached thereto, the second having a filler tube attached thereto with a spring-biased safety cap thereon, a rigid carrying handle mounted between the pouring spout and the filler tube, and means extending below the carrying handle for opening the pouring spout and simultaneously lifting the spring-biased safety cap.

8 Claims, 3 Drawing Figures

SAFETY CONTAINER FOR FLAMMABLE LIQUIDS

FIELD OF THE INVENTION

This invention relates to a safety container for the storage and dispensing of liquid fuels and other volatile liquids, from which the contents usually are dispensed at more or less frequent intervals, especially a safety container having two openings, one having a pouring spout attached thereto, the second having a filler tube attached thereto with a spring-biased safety cap thereon. The safety cap is manually raised for filling the container with liquid and means are provided for automatically lifting the safety cap when the liquid is poured from the safety container. Venting the contents of the safety container occurs through the second opening. The container herein is referred to as a "safety container" because, if it is not deliberately opened, flammable or noxious vapors cannot escape therefrom and the container is safe even if it is dropped or falls in an inverted position or strikes some object which might otherwise have resulted in escape of liquid and/or vapors therefrom.

BACKGROUND OF THE INVENTION

Containers for flammable liquids having two openings therein, one for pouring and another for filling are known. In some cases these openings function independently of each other and require additional venting means, which can involve additional costs in material and labor in producing such a container. In other such cases, the safety of one using such containers can be jeopardized, because the trigger means used to operate the container has a high profile and can be accidentally activated. This can be particularly hazardous when the actuating means and the carrying means are combined and the container is being carried by hand without any immediate desire to discharge liquid therefrom.

In the prior art, Packer in U.S. Pat. No. 2,335,195 discloses a container having a discharge spout, a closure pivotally associated with the spout, a carrying handle for the container and a link connected at one end to the closure and operatively connected at the other end to the carrying handle. Flider in U.S. Pat. Nos. 3,727,807 and 3,729,129 discloses a container having separate pour and fill spouts and a carrying handle having a high profile that also serves as an actuating means for opening each of said spouts. Flider in U.S. Pat. No. 4,063,667 also discloses a container having separate pour and fill spouts but no means to open the fill spout during the pouring operation. Pratz et al in U.S. Pat. No. 4,491,251 disclose a single spout in a container for filling and discharging fluid from a container and means, including a pair of handles, for opening and closing said spout.

The safety container for flammable liquids disclosed and claimed herein has many unusual and attractive features. It has a small number of components and moving parts and is of simplified construction and assembly. It has separate pour and fill spouts and provisions for automatic venting through the fill spout during the pouring operation. The trigger mechanism, separate and distinct from the carrying means, is confined under, and protected by, the carrying means, resulting in a low profile therefor, thereby reducing the chance of accidental discharge of liquid fuels and other volatile liquids therefrom.

SUMMARY OF THE INVENTION

The invention claimed herein relates to a safety container for flammable liquids comprising a filler valve mechanism mounted on the top wall of the safety container adjacent one edge thereof and a pour valve mechanism mounted on the top wall of the safety container adjacent the edge thereof opposite the filler valve mechanism. The filler valve mechanism is provided with a spring-biased filler cap having a lip thereon extending outwardly therefrom in the direction of the pour valve mechanism. The pour valve mechanism is provided with valve means for opening and closing the pour valve mechanism so that flammable liquid can be discharged from the container as desired. A valve stem trigger means is pivotally mounted to a spring-biased, elongated valve stem of the valve means and extends below the lip of the filler cap. A rigid carrying handle, secured at its ends to the top wall of the container, is provided that extends laterally over the valve stem trigger means. The valve stem trigger means includes a portion substantially parallel to the carrying handle disposed between the carrying handle and the pour valve mechanism.

DETAILED DESCRIPTION OF THE DRAWINGS

Figure 1:
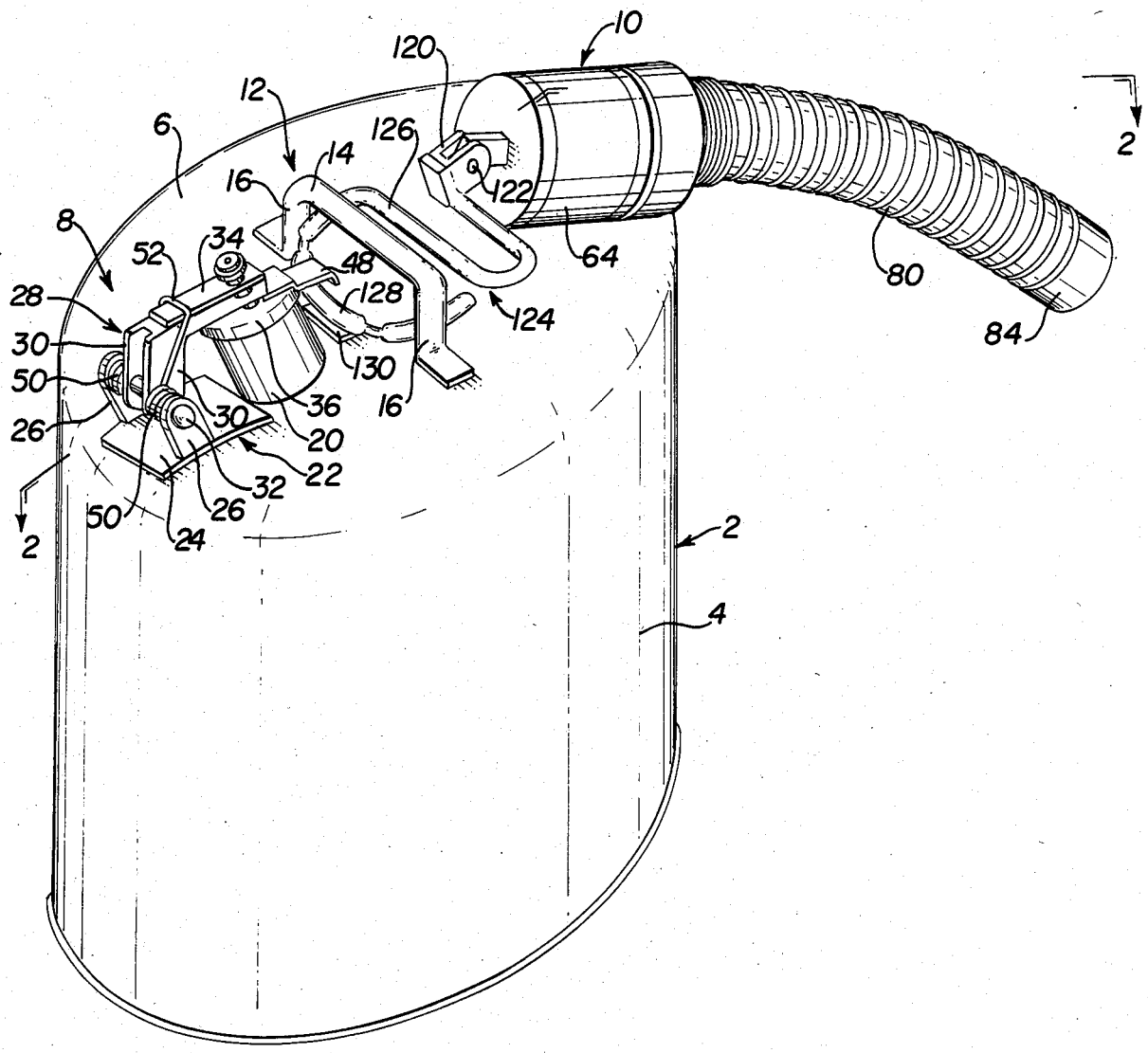
FIG. 1 is a perspective view of the novel container for flammable liquids claimed herein.

Referring to the drawings, there is shown the novel safety container 2 herein comprised of a one-piece cylindrical body 4 with a slightly rounded or dome-like integral top wall 6, as herein illustrated, although the invention is applicable to containers of other contours and construction. The bottom wall of the container, having a one-piece body, whose specific construction is not shown herein, is preferably a separately-formed disk, the periphery of which is seamed to the lower end of the cylindrical body 4. The safety container 2 is preferably made of galvanized, non-chromate steel.

Figure 3:
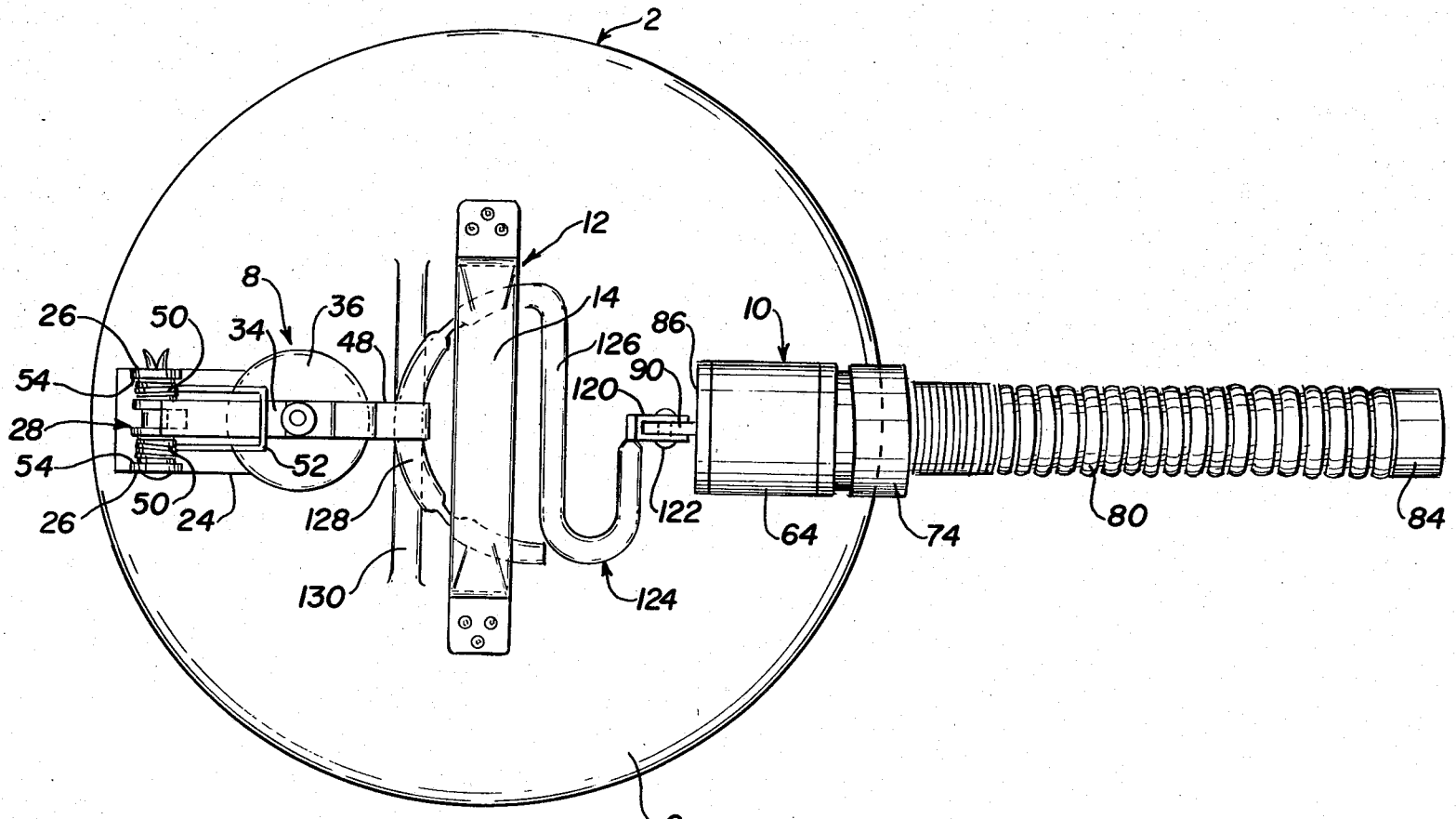
FIG. 3 is a plan view of the novel container herein.

Mounted on top wall 6 is a filler valve mechanism 8 and a pour valve mechanism 10. The filler valve mechanism 8 is mounted on top wall 6 adjacent the periphery thereof and the pour valve mechanism 10 is mounted on top wall 6 adjacent the opposite periphery thereof. Securely fixed to top wall 6 of container 2, at or near the center thereof, is a lifting or carrying handle 12 in the form of a flat arch having a grip bar 14 extending between upright supports 16 at each end, the grip bar 14 being elevated well above the top wall 6 of the container so that it may be easily grasped and to provide space thereunder for the trigger means, defined hereinafter, and to protect the same against accidental or undesired actuation thereof. Filler valve mechanism 8, pour valve mechanism 10 and carrying handle 12, as well as all of their associated parts, are substantially centered in the vertical plane taken along the line 2—2 shown in FIG. 1. As shown in FIG. 3, a vertical plane therethrough extends diagonally across the diameter of the top wall 6 of the container 2.

In the portion of the top wall 6 carrying filler valve mechanism 8, there is provided an opening 18 in which there is securely mounted a filler tube 20 extending outwardly therefrom. Preferably, filler tube 20 is mounted on the top wall 6 of the container by crimping and soldering the same thereto.

A U-shaped bracket 22 secured, for example, by welding to top wall 6, is positioned thereon between filler tube 20 and the adjacent periphery of the top wall 6 and comprises base 24 and upwardly extending parallel arms 26. A bell crank lever 28, formed, for example, of pressed metal, the major portion of which is an inverted channel with parallel downturned arms 30, extends between the upwardly extending parallel arms 26 of U-shaped bracket 22. A pivot pin 32 passing transversely through the arms 26 of the bracket 22 also passes through the downturned arms 30 of bell crank lever 28, providing a fulcrum about which the bell crank lever 28 can rock in a vertical arc. The other end of the bell crank lever 28 has an outwardly extending tongue portion 34 that reaches radially part way across the above filler tube 20.

A filler cap 36 is secured to the underside of tongue portion 34 of bell crank lever 28, in any suitable manner, provided that filler cap 36 in closed position fits over the opening in filler tube 20. For example, filler cap 36 can be secured to tongue portion 34 by securely attaching a bell crank clinch nut 38 (FIG. 2) at one end to the top side of the filler cap 36 and at the other end to a clinch washer 40 mounted on tongue portion 34 of bell crank lever 28. A filler cap gasket 42 is suitably mounted within filler cap 36 using a screw 44 that fits within the interior threaded portion 46 of bell crank clinch nut 38. Secured to the top of filler cap 36, for example, by welding, is a fill cap lift 48 having a lip that extends outwardly, and then, preferably downwardly, in the direction of pour valve mechanism 10.

A pair of torsion springs 50 are mounted around pivot pin 32 between the outer portions of downturned arms 30 of bell crank lever 28 and the inner portions of upwardly extending arms 26 of U-shaped bracket 22, there being a bail-like extension 52 extending over bell crank lever 28. Bushings 54 are mounted on pivot pin 32 on each side of torsion springs 50. This arrangement normally exerts a strong pressure on bell crank lever 28 to maintain filler cap 36 tight against filler tube 20. Mounted within filler tube and extending inwardly into the body of the container 2 is a tubular flame arrestor 56 preferably made of a wall of brass or galvanized steel wire mesh.

In the portion of the top wall 6 carrying pour valve mechanism 10, there is provided an opening 58 in which there is securely mounted a cylindrical tubular valve body adapter 60 extending outwardly therefrom having a laterally-extending circumferential flange 62 resting on the adjacent top wall of cylindrical body 4. Preferably, valve body adapter 60 is mounted on the top wall 6 of the container by crimping and soldering the same thereto. A cylindrical pour valve body 64 having an opening 66 in the wall thereof having a diameter just slightly greater than the outer diameter of valve body adapter 60 is mounted onto the valve body adapter 60 by forcing the upper free end of the valve body adapter through said opening 66 in pour valve body 64, with the adjacent outer wall of pour valve body 64 resting on flange 62 of valve body adapter 60. The pour valve body 64 is preferably securely attached to valve body adapter 60 by brazing the same thereto. One end of pour valve body 64 extends outwardly toward the periphery of container 2, while the other end extends inwardly towards carrying handle 12.

Fixed by brazing, for example, to said one end of pour valve body 64 is a valve seat body 68 provided with a laterally extending circumferential flange 70 intermediate the ends thereof that abuts the adjacent outer end of pour valve body 64. One end of said valve seat body 68 extends into pour valve body 64, while the other end extends outwardly therefrom and carries threads 72 on the outer free surface thereof. A flex spout coupling 74 carrying internal threads at one end thereof corresponding to exterior threads 72 on valve seat body 68 is threadedly attached thereto. Interposed between the outer end of valve seat body 68 and flex spout coupling 74 is flex spout gasket 76. The outer end of flex spout coupling 74 is provided with an outwardly extending circumferential flange 78 inside which there is disposed a flexible hose 80 secured thereto, for example, by soldering. Disposed about flexible hose 80, adjacent flex spout coupling 74 is a flex hose spring 82 attached to flex spout coupling 74, for example, by soldering. At its free end, flexible hose 80 is provided with a flex hose ferrule 84.

The other end of pour valve body 64 is threaded on the interior portion thereof to receive the threaded outer portion of valve end cap 86 having an opening 88 therein through which valve stem 90 can pass laterally therethrough. Disposed between a laterally-extending circumferential lug 92 on valve end cap 86, and the adjacent outer edge of pour valve body 64 is valve cap gasket 94.

Disposed across opening 96 and seated on the face 98 of valve seat body 68 is a valve seat washer 100. Interposed between valve seat washer 100 and the face 98 of valve seat body 68 is a valve seat gasket 102. Valve seat gasket 102 is attached to valve seat washer 100 using valve stem screw 104. Valve stem screw 104 projects outwardly from valve seat washer 100 axially into one end of valve stem 90, thus securely attaching valve stem 90 to valve seat washer 100. The inner face of valve end cap 86 is provided with a recess 106 in which there is seated a valve stem O-ring 108 provided with a laterally extending flange 110 at the free end thereof. Disposed about valve stem 90 and between flange 110 and valve seat washer 100 is coiled valve stem spring 112. Coaxially disposed within pour valve body 64 is a tubular valve flame arrestor 114, made of brass or steel plated perforated metal, wherein the end portions thereof fit into frictional engagement with valve end cap 86 and valve seat body 68 within circumferential grooves 116 and 118, respectively.

The free end of valve stem 90 exterior of pour valve body 64 is pivotally attached to trigger clevis 120 by means of valve stem rivet 122. The trigger clevis 120 is fixedly attached, for example, by spot welding, to valve stem trigger means 124, which can be for example, tubular in shape. The valve stem trigger means 124 extends across the top wall 6 of container 2 and is disposed below carrying handle 12. A portion 126 of valve stem trigger means 124 is substantially parallel to carrying handle 12 and is disposed between carrying handle 12 and poor valve mechanism 10 (FIG. 3). A portion 128 of the remainder of valve stem trigger means 124, is disposed laterally below fill cap lift 48. A buffer plate 130 may be provided on top wall 6 for resting of portion 128 of valve stem trigger means 124 thereon.

In operation, a user will be able to carry the safety container herein safely without accidentally actuating the pour valve mechanism, since the actuating means, that is, valve stem trigger means 124, lies well under the protection of carrying handle 12. Additionally, because of this unique arrangement, the safety container herein can be dropped without accidental escape of liquid and/or vapors therefrom, for the carrying handle 12 will prevent any contact between the actuating means 124 and any means external thereof.

Figure 2:
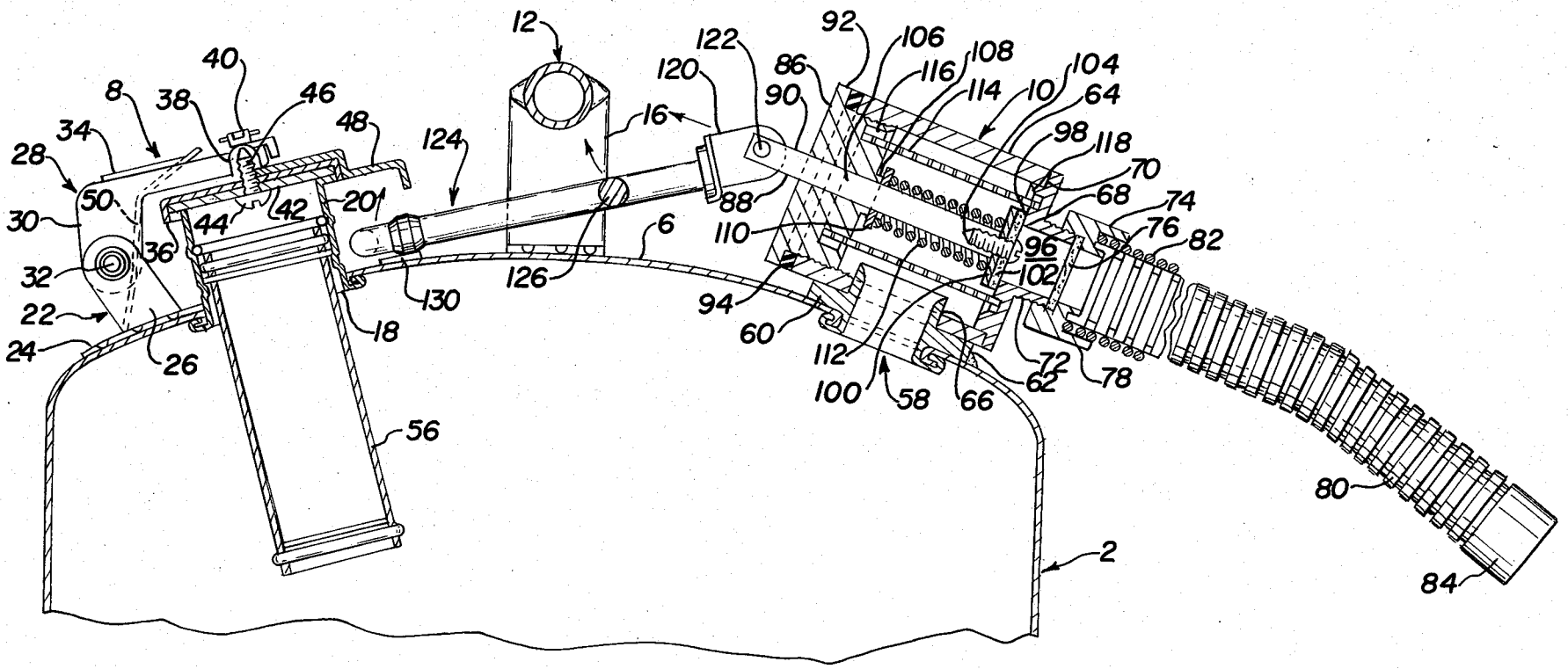
FIG. 2 is an elevational, cross-sectional view of the novel container for flammable liquids taken substantially along the line 2—2 shown in FIG. 1.

The safety container herein is simply filled through filler tube 20 after fill cup lift 48 has been raised by upward tilt of fill cap lift 48 on filler cap 36. To pour from the container the user grips with one hand around both rigid carrying handle 12 and portion 126 of valve stem trigger 124. While squeezing these substantially parallel members together, and by lifting the container, the user can use his other hand to tilt the bottom rim of the container below the filler valve mechanism 8 to control pouring from the pour valve mechanism 10. Pouring occurs because the squeeze-lift action described above causes portion 128 of valve trigger means 124 to rise in contact with the fill cap lift 48, causing fill cap lift 48 to rise, thereby permitting venting to occur through filler tube 20. At the same time valve stem 90 moves outwardly against the bias of valve stem spring 112, thereby opening the seal between valve seat gasket 102 and valve seat body 68. This is shown in FIG. 2 by arrows.

Thus, the safety container herein can be easily filled, safely actuated, with automatic venting, when it is desired to dispense liquid fuels therefrom, and is provided with means to prevent accidental discharge of liquid fuels therefrom.

We claim:

1. A safety container for flammable liquids comprising a filler valve mechanism mounted on the top wall of said container adjacent one edge thereof, a pour valve mechanism mounted on said top wall of said container adjacent the edge thereof opposite said filler valve mechanism, said filler valve mechanism being provided with a spring-biased filler cap having a lift thereon extending outwardly therefrom in the direction of said pour valve mechanism, said pour valve mechanism having valve means therein for opening and closing said pour valve mechanism, a spring-biased, elongated valve stem attached to said valve means, a valve stem trigger means pivotally mounted to said valve stem at one end thereof and extending at its outer end below said lift of said filler cap, and a rigid carrying handle secured at its ends to said top wall of said container extending laterally over said valve stem trigger means, a portion of said valve stem trigger means being substantially parallel to said carrying handle and being disposed between said carrying handle and said pour valve mechanism.

2. The safety container of claim 1 wherein said valve stem trigger means extends laterally below said lift of said filler cap.

3. The safety container of claim 1 wherein said carrying handle and said portion of said valve stem trigger means lying between said carrying handle and said pour spout mechanism are in such close proximity so that grasping said carrying handle and said portion of said valve stem trigger means by a user's hand enables opening of said valve means and the simultaneous lifting of said filler cap to vent the interior of said container.

4. The safety container of claim 1 wherein said carrying handle, said filler valve mechanism, said pour valve mechanism and the parts associated therewith are substantially centered in the vertical plane that extends diagonally across the diameter of said top wall of said container.

5. The safety container of claim 1 wherein said pour spout mechanism is provided with a flexible hose for discharging the contents of said container.

6. A safety container for flammable liquids comprising a filler valve mechanism mounted on the top wall of said container adjacent one edge thereof, a pour valve mechanism mounted on said top wall of said container adjacent the edge thereof opposite said filler valve mechanism, said filler valve mechanism being provided with a spring-biased filler cap having a lift thereon extending outwardly therefrom in the direction of said pour valve mechanism, said pour valve mechanism having valve means therein for opening and closing said pour valve mechanism, a spring-biased, elongated valve stem attached to said valve means; a valve stem trigger means pivotally mounted to said valve stem at one end thereof and extending at its outer end laterally below said lift of said filler cap, a rigid carrying handle secured to said top wall of said container extending laterally over said valve stem trigger means, said valve stem trigger means, comprising a portion substantially parallel to said carrying handle and being disposed between said carrying handle and said pour valve mechanism, said carrying handle and said portion of said valve stem trigger means lying between said carrying handle and said pour spout mechanism being in such close proximity so that grasping said carrying handle and said portion of said valve stem trigger means by a user's hand enables opening of said valve means and the simultaneous lifting of said filler cap to vent the interior of said container.

7. The safety container of claim 6 wherein said carrying handle, said filler valve mechanism, said pour valve mechanism and the parts associated therewith are substantially centered in a vertical plane that extends diagonally across the diameter of the top wall of the container.

8. The safety container of claim 7 wherein said pour spout mechanism has thereon a flexible hose for discharging the contents of said container therethrough.

* * * * *